US005174282A

United States Patent [19]

Bleggi

[11] Patent Number: 5,174,282

[45] Date of Patent: Dec. 29, 1992

[54] MASSAGE APPARATUS

[76] Inventor: Nick T. Bleggi, 39142 Meeting House La., Livonia, Mich. 48154

[21] Appl. No.: 716,505

[22] Filed: Jun. 17, 1991

[51] Int. Cl.[5] ..... A61H 15/00

[52] U.S. Cl. ..... 128/57

[58] Field of Search ..... 128/57-62 R, 128/69

[56] References Cited

U.S. PATENT DOCUMENTS

| | | | |
|---|---|---|---|
| 781,683 | 2/1905 | Shepherd | 128/57 |
| 863,143 | 8/1907 | Bowser | 128/57 |
| 1,014,774 | 1/1912 | Rohrer | 128/57 |
| 1,257,957 | 2/1918 | Kost | 128/57 |
| 1,560,549 | 11/1925 | Duncan | 128/57 |
| 2,466,470 | 4/1949 | Norris | 128/57 |
| 2,819,714 | 9/1952 | London | 128/57 |
| 3,705,579 | 12/1972 | Morini | 128/57 |
| 4,374,519 | 2/1983 | Stauft | 128/57 |
| 4,989,585 | 2/1991 | Auker | 128/57 |

FOREIGN PATENT DOCUMENTS

| | | | |
|---|---|---|---|
| 645391 | 5/1937 | Fed. Rep. of Germany | 128/62 |

*Primary Examiner*—Robert A. Hafer
*Assistant Examiner*—David J. Kenealy
*Attorney, Agent, or Firm*—Lyon & Delevie

[57] ABSTRACT

A system for alternately applying and releasing pressure on the muscles of the back comprising a plurality of spaced elasomeric balls that are rotatably supported by a carrier. The balls are positioned between the user's back and a vertical surface with the balls orientated on opposite sides of the spinal column. Vertical movement of the user's back due to bending of the knees effects movement of the balls relative to the user's back and controlled massage of the user's back muscles.

2 Claims, 1 Drawing Sheet

MASSAGE APPARATUS

Exercise or abnormal stress often precipitates the buildup of lactic acid in the body musculature. Such lactic acid buildup may result in muscular ache or pain which often can be alleviated by massage of the muscles involved. Massage effects alternate compression of the muscle, which forces blood outwardly of the blood vessels therein, and release of compression which allows blood to flow back into the blood vessels. The pumping action on the fluid contents of the blood vessels stimulates circulation and purging of excess lactic acid from the muscle.

SUMMARY OF THE INVENTION

The present invention relates to a massage apparatus and exercise system for alternately applying and releasing pressure on the muscles of the back in the massage mode and exercise of lower body muscle groups in the exercise mode. The apparatus comprises a plurality of spaced elasomeric balls that are rotatably supported by a carrier. The balls are positioned between the user's back and a vertical surface with the balls orientated on opposite sides of the spinal column.

One feature of the system is that the user himself can precisely control the amount of pressure exerted by the balls and therefore the degree of compression of the back muscles. The user stands erect adjacent a vertical surface and places the balls at a desired location on his body, for example, adjacent the sacrum or lower back area, and leans backwardly toward the vertical surface. Spacing of the user's feet from the vertical surface dictates the amount of pressure the balls will exert on the user's back muscles. As the user bends his knees his back moves downwardly relative to the vertical surface but the balls move upwardly on his back, for example, from the sacrum area to the shoulder area. Because the user is standing, his weight is self supporting and does not unduly influence pressure exerted by the balls on the back muscles. Stated in another manner, the user has positive control of massage pressure on opposite sides of the spinal column as the user bends and straightens his knees. Because the apparatus is lightly suspended on a resilient cord, the balls can be positioned or focused on a tense area. The resultant gentle massaging of the back muscles due to use of the system of the invention purges the muscles of lactic acid, a primary cause of muscle stiffness, thereby relieving tense, fatigued areas of the back. It is to be noted that, when used as described above, the system of the present invention inherently effects massage of the inner and outer urinary bladder meridian, releasing energy blocks.

The massage apparatus of the present invention can be used to facilitate exercise of certain lower body muscle groups. For example, movement from the position of FIG. 1 to the position of FIG. 2 and return strengthens weak quadriceps. Lack of anterior support of the knee by weak quadriceps is a major cause of knee hyperextension.

Lower back musculature is also stretched and strengthened by the aforesaid movement. Weak rectus femoris muscles allow posteriority of the pelvis resulting in a decreased lumbar lordotic curve which, in turn, may result in increased pressure on the legs, vertebral motor unit, and respective facet joints which manifests itself in lower back musculature spasm.

In addition to exercise of the rectus femoris muscles, use of the massage apparatus of the invention exercises the other muscles of the quadriceps femoris group, namely, the vastus lateralis, vastus intermedius, and vastus medialis muscle groups.

DETAILED DESCRIPTION OF THE PREFERRED EMBODIMENT OF THE INVENTION

Figure 1:
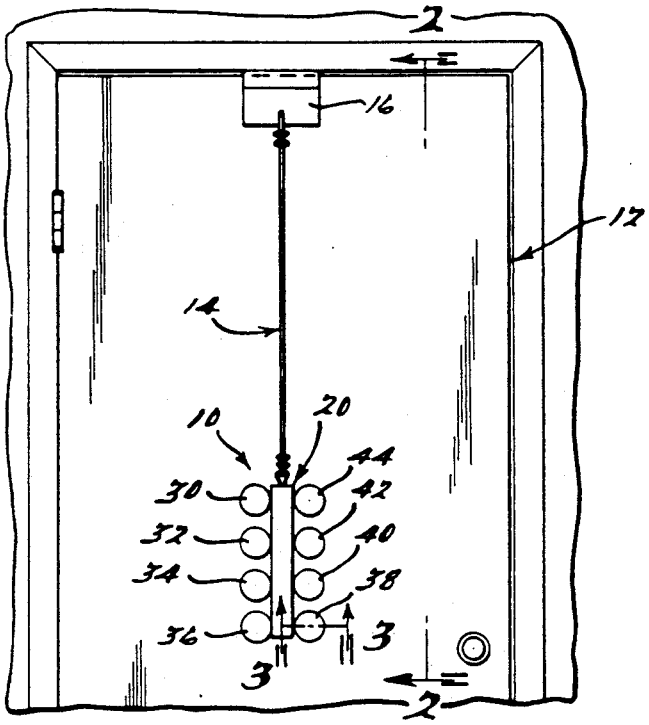
FIG. 1 is an elevational view of the massage apparatus of the instant invention shown operatively mounted on a conventional door.

As seen in FIG. 1 of the drawings, a massage system 10 is suspended from, for example, a door 12 by a resilient cord 14. The cord is secured to a U-shaped clip 16 designed to be engaged over the top edge of the door 12.

The massage system 10 comprises a carrier 20 that is suspended from the cord 14. The carrier 20 comprises, for example, a wooden block that in a constructed embodiment of the invention, is 12 inches long, 2 inches wide and $\frac{3}{4}$ inch thick.

Figure 3:
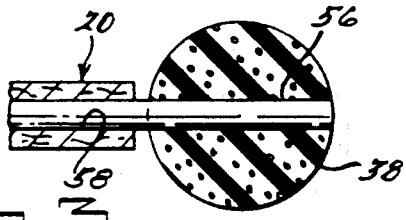
FIG. 3 is a cross-sectional view taken along the line 3—3 of FIG. 1.
Figure 4:
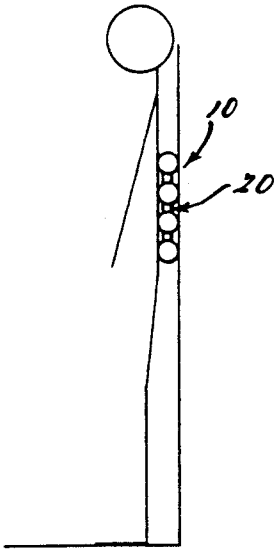
FIG. 4 is a diagramatic view of the massage apparatus in a starting position.
Figure 5:
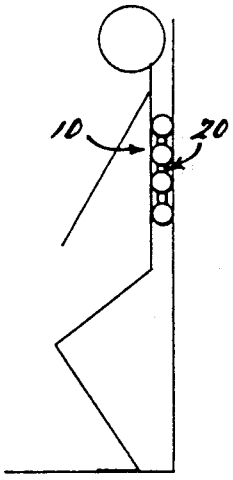
FIG. 5 is a view similar to FIG. 3 showing the massage apparatus elevated to an upper position on the back of a user due downward movement of the user's back due upon bending of the knees.
Figure 2:
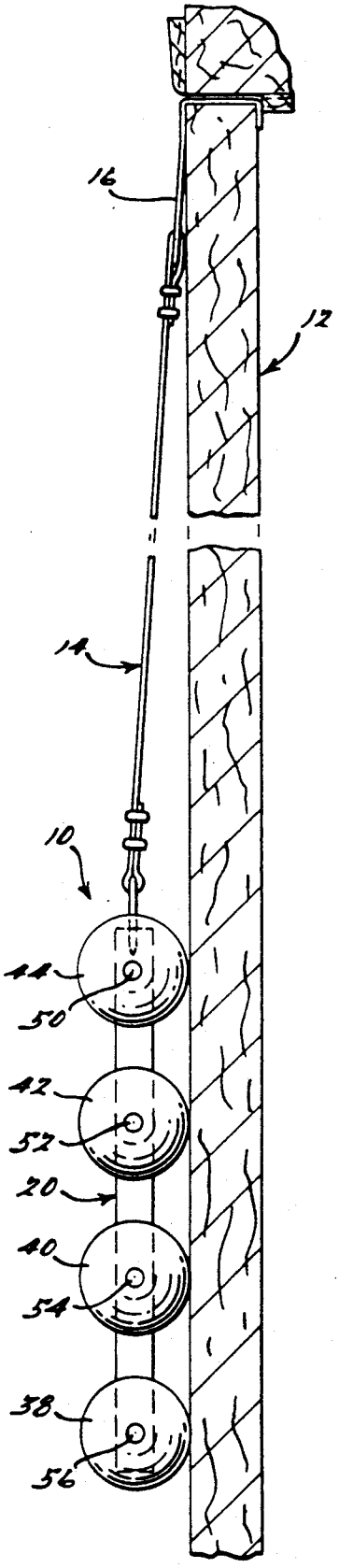
FIG. 2 is a cross-sectional view taken substantially along the line 2—2 of FIG. 1.

A plurality of resilient balls 30–44 made from, for example, relatively dense sponge rubber and having a diameter of 2.5 inches are orientated in pairs on opposite sides of the carrier 20 on a plurality of spindles 50–56, respectively. The balls 30–44 of each pair are longitudinally spaced from one another approximately 2 inches and are adhesively secured to the spindles 50–56 so as to be rotatable therewith. The spindles 50–56 are laterally spaced from one another approximately 3 inches and are journaled in four complementary bores, respectively, one of which is shown in FIG. 3 and identified by the numeral 58.

In operation, the user first places the carrier 20 between his back and a vertical surface. As the user bends his knees, the carrier 20 and balls 30–44 move up the user's back. The resilient balls 30–44 alternately gently compress then release the spinal erector and fascia muscles of the back on opposite sides of the spinal column inervating said muscles. Pressure from the rolling balls effects an emptying of the blood vessels in the compressed musculature. Once the balls have rolled over a specific area of the back musculature, pressure on the blood vessels therein is released, allowing them to refill. Lactic acid buildup in the muscles is redistributed into the vascular system via the resultant pumping mechanism which alleviates muscle stiffness, relieves tension, and relaxes fatigued areas of the back. In accordance with one feature of the invention, the alternate compression and release action of the rolling balls acts as a blood pumping mechanism that, in terms of both pressure and rate, is fully under the user's control.

While the preferred embodiment of the invention has been disclosed, it should be appreciated that the invention is susceptible of modification without departing from the scope of the following claims.

I claim:

1. A back massage apparatus for use by a user while in a standing position on a floor in close proximate relation to a fixed vertical surface, said apparatus comprising a carrier, a plurality of spaced parallel spindles supported by said carrier, a plurality of resilient rotatable balls disposed in axially spaced relation on opposite ends of said spindles, respectively, and resilient means for suspending said apparatus at an initial position in spaced relation to said floor with the spindles thereof extending horizontally, said resilient means guiding said apparatus for vertical reciprocation above and below said initial position, said apparatus being positionable by a user in a standing position between the user's back and said vertical surface, downward movement of the user's back due to bending of the knees effecting upward movement of the massage apparatus on the user's back and an increase in the tension of said resilient means on said apparatus within the elastic limit thereof, upward movement of the user's back due to straightening of the knees effecting downward movement of the massage apparatus on the user's back and the partial release of tension in said resilient means, the user's body weight being supported at all times primarily by the legs of the user, so as to permit the user to control the reaction pressure of said balls on the user's back.

2. A method of self massage of the human back by a patient comprising the steps of;

providing a horizontal surface, providing a vertical surface, providing a massage apparatus comprising a pair of resilient balls mounted on a common shaft in axially spaced relation, resiliently suspending said massage apparatus at an initial position in vertically spaced relation above said horizontal surface and against said vertical surface with the shaft of said apparatus extending horizontally, standing on said horizontal surface adjacent said vertical surface, orientating said massage apparatus between the user's back and said vertical surface with the balls thereof on opposite sides of the user's spinal column, shifting a small portion of the user's body weight horizontally toward said vertical surface thereby to compress the balls of said apparatus, bending the knees of the user to move the massage apparatus upwardly on the user's back and to effect an increase of the upward bias of said resilient means on said apparatus, straightening the knees of the user to effect downward movement of the massage apparatus on the user's back and a release of tension in said resilient means, the user's body weight being supported primarily by said floor to permit the user to control the reaction pressure of said balls on the user's back, and guiding said massage apparatus by the resilient suspension for vertical movement above and below said initial position.

* * * * *